United States Patent [19]

Strindehag

[11] 4,084,633

[45] Apr. 18, 1978

[54] ROTOR FOR ROTARY HEAT EXCHANGERS

[75] Inventor: Ove Magnus Strindehag, Jonkoping, Sweden

[73] Assignee: AB Svenska Flaktfabriken, Nacka, Sweden

[21] Appl. No.: 737,506

[22] Filed: Nov. 2, 1976

[30] Foreign Application Priority Data

Nov. 12, 1975 Sweden ..... 7512674

[51] Int. Cl.[2] ..... F28D 19/00

[52] U.S. Cl. ..... 165/8; 165/10

[58] Field of Search ..... 165/8, 9, 10

[56] References Cited

U.S. PATENT DOCUMENTS 3,183,963 5/1965 Mondt ..... 165/10

3,532,157 10/1970 Hubble ..... 165/10 X

*Primary Examiner*—Albert W. Davis, Jr.

*Attorney, Agent, or Firm*—Dorfman, Herrell and Skillman

[57] ABSTRACT

A rotor for a rotary heat exchanger comprising a plurality of successive circumferential layers of corrugated foil. The corrugated foil in the adjacent layers may be joined by plane foil layers interposed between adjacent layers of corrugated foil, or may be joined directly to each other. The foil adjacent the hub of the rotor is of greater strength than the foil adjacent the periphery, preferably by providing a greater thickness in the foil in the inner layers as compared to the foil in the outer layers.

7 Claims, 4 Drawing Figures

ROTOR FOR ROTARY HEAT EXCHANGERS

This invention relates to a rotor for rotary heat exchangers for heat exchange between two airstreams.

Regenerative heat exchangers are highly suitable for use in the recovery of heat from ventilation air or from air or gases from industrial processes, because such heat exchangers have a relatively high efficiency degree and, besides, can transfer moisture. Regenerative heat exchangers usually comprise a rotary disc-shaped heat exchanger body, which is assembled of alternatingly plane and corrugated foils of paper, asbestos or metal. The plane and corrugated foils usually are joined by gluing.

In the case of heat exchanger rotors of paper, asbestos or similar material, the rotor most often must be assembled about bearing structural members of metal in order to provide the rotor with the necessary mechanical strength. This applies particularly to large rotors having a diameter of several meters. The bearing structural members may consist of radial spokes and annular elements, which are concentric with the rotor hub. Rotors of this design are described in the Swedish patent specification No. 348,826.

Heat exchanger rotors assembled of metal foils, for example aluminium, have the advantage of rendering it possible to manufacture relatively large rotors without having to provide them with extra bearing structural members. This, of course, reduces the manufacturing costs. However, also in the case of rotors assembled of metal foils, problems arise with respect to achieving a mechanical strength, which is sufficient also for really large rotors. The strength of the rotor, certainly, can be increased by increasing the thickness of the metal foils, but this results in a higher rotor weight, which in its turn implies higher stresses on the rotor portions or zones closest to the hub. An increase of the thickness of the foil material, moreover, renders the rotor substantially more expensive.

The object of the present invention is to produce a heat exchanger rotor without the aforesaid disadvantages.

This object is achieved by a rotor assembled of alternatingly plane and corrugated foils of aluminium, and the design advantageous from the aspect of strength is obtained by the thickness of these foils decreasing with the distance from the hub, preferably in two, three or more steps. The principle, of course, is also applicable to other materials and to different designs of the corrugated web.

The rotor, for example, can also be assembled of a single corrugated web of suitable design.

Figure 1A:
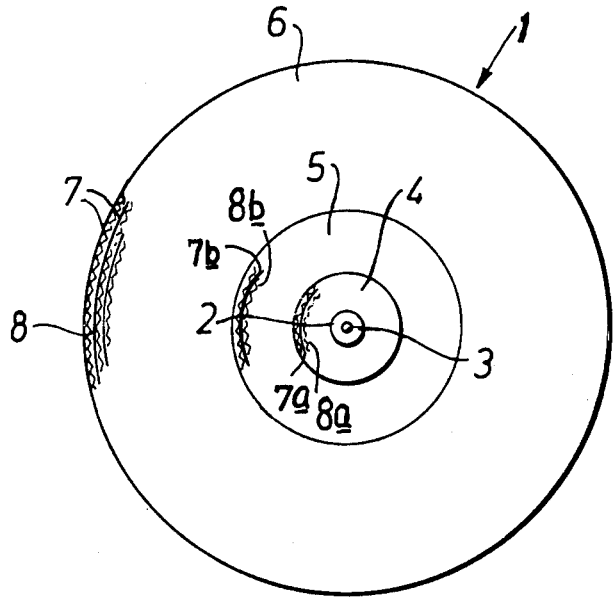
Figure 1B:
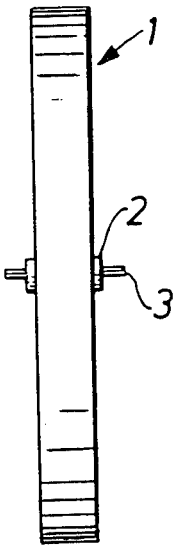
Figure 2:
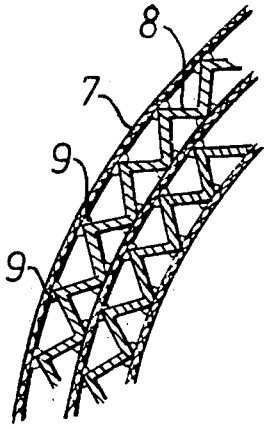
Figure 3:
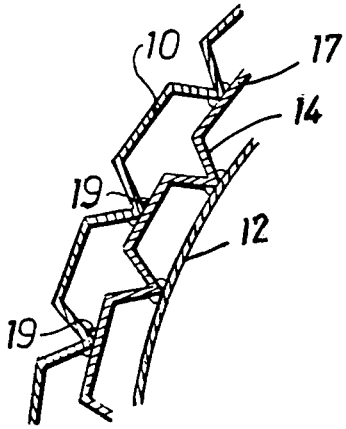

The invention is described in greater detail in the following, with reference to the accompanying drawing, in which:

FIGS. 1*a* and 1*b* show a rotor assembled of three different thicknesses of foil material, FIG. 1*a* being a front view and FIG. 1*b* being a lateral view of the rotor;

FIG. 2 is a detail view of a rotor assembled of alternating circumferential layers of plane and corrugated foils; and FIG. 3 is a detail view of a rotor assembled only of layers of corrugated foil.

The heat exchanger rotor 1 shown in FIG. 1 is assembled about a cylindric hub 2 with an axle 3. The rotor is manufactured by winding alternating circumferential layers of a plane foil 7 and a corrugated foil 8 about the hub 2. The rotor portion or zone 4 closest to the hub 2 is built up of thicker foils 7*a* and 8*a* than corresponding foils in the rotor portions or zones 5 and 6. In like manner, the foils 7*b* and 8*b* have a greater thickness in the layers of rotor zone 5 than in the layers of rotor zone 6. The foils 7 and 8 must not necessarily have equal relative thickness in the layers of different rotor zones 4, 5 and 6, nor is it necessary to simultaneously increase the thickness of the plane foil 7 and corrugated foil 8 in the layers of inner rotor zones 4 and 5. It also is possible to choose a material of greater strength in the layers of rotor zone 4 than in the layers of the remaining zones of the rotor, and different materials may also be chosen in the layers of rotor zones 5 and 6.

As appears from FIG. 2, the plane foil 7 can be joined with the corrugated foil 8, for example by a glue line 9. In the rotor zone 4, the joining of the foils 7*a* and 8*a* is required to be more efficient than in the remaining zones of the rotor. This can be achieved, provided the joining is carried out by gluing, by laying a relatively substantial glue line in the rotor zone 4.

At a rotor assembled of aluminium foils of the kind shown in FIGS. 1 and 2, the foil thickness in the layers of rotor zone 4 may be in the range between 0.12 and 0.20 mm, for example 0.15 mm, in the layers of rotor zone 5 may be in the range between 0.07 and 0.12 mm, for example 0.10 mm, and in the layers of rotor zone 6 may be in the range between 0.03 and 0.07 mm, for example 0.05 mm. As an example may also be mentioned that at an outer diameter of the rotor of 3.5 m, the diameter of the rotor zones 4 and 5 preferably can be chosen to be about 0.8 m and about 1.7 m, respectively.

In FIG. 3, another mode of assembly of the rotor 1 is shown where only a corrugated foil 10 is utilized in each layer. In this figure, the corrugated foil 10 is wrapped around a hub 12 in layers and consists of V-shaped corrugations 14 which are spaced apart circumferentially by spacer segments 17. The corrugations 14 of one layer are joined to the segments 17 of the adjacent layer, for example by glue lines 19. The aforedescribed principle of using in the inner rotor zones 4 and 5 thicker foils or foils of materials having a higher strength can be applied also in this case.

The corrugation embodiments of the foils shown in FIGS. 2 and 3, of course, can be varied in several ways. As one example, the thickness or strength of the foil may be decreased gradually and continuously from the hub outwardly to the outer periphery.

I claim:

1. A rotor for heat exchangers, substantially for heat exchange between two airstreams, where the rotor is assembled of a plurality of circumferential layers of corrugated foil, characterized in that the foil in the inner layers closest to the rotor center has a higher mechanical strength than the foil in the outer layers close to the rotor periphery, said foil in said inner layers is of greater thickness than the foil in the outer layers.

2. A rotor according to claim 1, characterized in that the rotor is divided in radial direction into at least two zones where the mechanical strength of the foil is highest in the rotor zone closest to the rotor center and decreases in the successive zones radially outward.

3. A rotor according to claim 1, characterized in that the rotor includes layers of plane foil material between said layers of corrugated foil material.

4. A rotor according to claim 1, characterized in that the successive layers of foil are interconnected by joints between the foil, and wherein the joint of inner zones of the rotor has a higher mechanical strength than the joint of foil material of the outer zones of the rotor.

5. A rotor according to claim 4, characterized in that the joint of the foil material consists of glue lines having a higher strength at the inner rotor zones than at the outer rotor zones.

6. A rotor according to claim 1, characterized in that the foil material consists of aluminium.

7. A rotor according to claim 6, characterized in that the rotor is divided into three rotor zones, and that the foil material in the innermost zone has a thickness of between 0.12–0.20 mm, in the central zone 0.07–0.12 mm and in the outermost zone 0.03–0.07 mm.

* * * * *